US008343081B2

(12) United States Patent
Walker

(10) Patent No.: US 8,343,081 B2
(45) Date of Patent: Jan. 1, 2013

(54) MECHANICAL CPR DEVICE WITH VARIABLE RESUSCITATION PROTOCOL

(75) Inventor: Rob Walker, Bothell, WA (US)

(73) Assignee: Physio-Control, Inc., Redmond, WA (US)

( * ) Notice: Subject to any disclaimer, the term of this patent is extended or adjusted under 35 U.S.C. 154(b) by 194 days.

(21) Appl. No.: 11/961,687

(22) Filed: Dec. 20, 2007

(65) Prior Publication Data

US 2008/0097258 A1 Apr. 24, 2008

Related U.S. Application Data

(62) Division of application No. 10/981,365, filed on Nov. 3, 2004.

(51) Int. Cl.
*A61H 31/00* (2006.01)

(52) U.S. Cl. ..... 601/41; 601/42; 601/43; 601/44; 601/107; 601/108; 601/152

(58) Field of Classification Search ..... 601/41–44, 601/107, 108, 152
See application file for complete search history.

(56) References Cited

U.S. PATENT DOCUMENTS

| | | | | |
|---|---|---|---|---|
| 4,397,306 | A | 8/1983 | Weisfeldt et al. | |
| 4,424,806 | A * | 1/1984 | Newman et al. | 601/41 |
| 4,928,674 | A * | 5/1990 | Halperin et al. | 601/44 |
| 5,020,516 | A * | 6/1991 | Biondi et al. | 601/44 |
| 5,261,394 | A * | 11/1993 | Mulligan et al. | 601/108 |
| 5,490,820 | A * | 2/1996 | Schock et al. | 601/41 |
| 5,743,864 | A * | 4/1998 | Baldwin, II | 601/41 |
| 5,997,488 | A * | 12/1999 | Gelfand et al. | 601/41 |
| 6,676,613 | B2 * | 1/2004 | Cantrell et al. | 601/41 |
| 7,311,680 | B2 * | 12/2007 | Lenhart et al. | 601/41 |
| 2004/0230140 | A1 * | 11/2004 | Steen | 601/41 |
| 2005/0165335 | A1 * | 7/2005 | Sherman et al. | 601/44 |
| 2006/0089574 | A1 * | 4/2006 | Paradis | 601/41 |
| 2007/0004992 | A1 * | 1/2007 | Van Brunt et al. | 601/41 |

OTHER PUBLICATIONS

The Free Dictionary, Definition of a mechanical device, p. 1 of 2, Apr. 9, 2012.*

Office Action in related U.S. Appl. No. 10/981,365 dated Jul. 31, 2009, (15 pgs).

Office Action dated Feb. 18, 2010 issued in U.S. Appl. No. 10/981,365, filed Nov. 3, 2004 by inventor Robert S. Walker.

Pre-Appeal Brief Request for Review filed May 17, 2010 in U.S. Appl. No. 10/981,365, filed Nov. 3, 2004 by inventor Robert S. Walker.

* cited by examiner

*Primary Examiner* — Clinton T Ostrup
(74) *Attorney, Agent, or Firm* — Marger Johnson & McCollom PC

(57) ABSTRACT

Methods to control the delivery of CPR to a patient through a mechanical CPR device are described. The method generally allows for a gradual increase in the frequency of CPR cycles. The gradual increase can be regulated by protocols programmed within the CPR device such as intermittently starting and stopping the delivery of CPR, accelerating the delivery of CPR, stepping up the CPR frequency, increasing the force of CPR, and adjusting the ratio of compression and decompression in a CPR cycle. Combinations of each of these forms may also be used to control the delivery of CPR. This manner of gradually accelerating artificial blood flow during the first minutes of mechanical CPR delivery can serve to lessen the potential for ischemia/reperfusion injury in the patient who receives mechanical CPR treatment.

13 Claims, 4 Drawing Sheets

MECHANICAL CPR DEVICE WITH VARIABLE RESUSCITATION PROTOCOL

RELATED APPLICATIONS

This application is a divisional of U.S. patent application Ser. No. 10/981,365, filed on Nov. 3, 2004, which is hereby incorporated by reference in its entirety.

FIELD OF THE INVENTION

The present invention generally relates to methods and apparatus for performing mechanical cardiopulmonary resuscitation or CPR. More particularly the present invention relates to the control of the delivery of CPR. Still more particularly, the present invention relates to protocols configured or programmed within the controller of a mechanical CPR device.

BACKGROUND OF THE INVENTION

CPR, as manually applied by human rescuers, is generally a combination of techniques including artificial respiration (through rescue breathing, for example) and artificial circulation (by chest compression). One purpose of CPR is to provide oxygenated blood through the body, and to the brain, in those patients where a prolonged loss of circulation places the patient at risk. For example after a period of time without restored circulation, typically within four to six minutes, cells in the human brain can begin to be damaged by lack of oxygen. CPR techniques attempt to provide some circulation, and in many cases, respiration, until further medical treatment can be delivered. CPR is frequently, though not exclusively, performed on patients who have suffered some type of sudden cardiac arrest such as ventricular fibrillation where the patient's natural heart rhythm is interrupted.

It has been found that the desired effects of CPR, when delivered manually, can suffer from inadequate performance. In order to have the greatest chance at success, CPR must typically be performed with some degree of force for an extended period of time. Often the time and exertion required for good performance of CPR is such that the human responder begins to fatigue. Consequently the quality of CPR performance by human responders may trail off as more time elapses. Mechanical CPR devices have been developed which provide chest compression using various mechanical means such as for example, reciprocating thrusters, or belts or vests which tighten or constrict around the chest area. In these automated CPR devices, motive power is supplied by a source other than human effort such as, for example, electrical power or a compressed gas source. Mechanical CPR devices have the singular advantage of not fatiguing as do human responders. Additionally, mechanical CPR devices may be advantageous when no person trained or qualified in manual CPR is able to respond to the patient. Thus, the advent of mechanical CPR devices now allows for the consistent application of CPR chest compressions for extended periods of time.

When a patient experiences cardiac arrest, the heart ceases to pump blood throughout the body. The cessation of blood flow is known as ischemia. When CPR chest compressions are commenced, some blood flow is restored. The restoration of blood flow after a period of ischemia is known as reperfusion. The study of CPR has revealed that after initial resuscitation from cardiac arrest, a cardiovascular postresuscitation "syndrome" often ensues, characterized by various forms of cardiac dysfunction. In many cases, this postresuscitation dysfunction can lead to heart failure and death. Furthermore, the study of reperfusion after ischemia has revealed that a particular kind of injury can develop in the first moments of reperfusion. This injury, known as ischemia/reperfusion injury, occurs for reasons not fully understood. It, however, is known to result in a variety of symptoms that can contribute to postresuscitation cardiac dysfunction. More importantly, ischemia/reperfusion injury is known to be affected by the quality of reperfusion experienced after a period of interrupted blood flow. A cardiac arrest patient, who has had no blood flow for several minutes, and who then receives CPR for some period of time, may be expected to experience ischemia/reperfusion injury.

Without wishing to be bound by any theory, the following explanation is offered to illustrate the current understanding of ischemia/reperfusion injury. Generally, ischemia/reperfusion injury initiates at the cellular level and chemically relates most strongly to the transition between conditions of anoxia/hypoxia (insufficient oxygen) and ischemia (insufficient blood flow), and conditions of proper oxygenation and blood flow. Pathophysiologically, reperfusion is associated with a variety of deleterious events, including substantial and rapid increases in oxidant stress, intracellular calcium accumulation, and immune system activation. These events can spawn a variety of injury cascades with consequences such as cardiac contractile protein dysfunction, systemic inflammatory response hyperactivation, and tissue death via necrosis and apoptosis. Unfortunately, following cardiac arrest, ischemia/reperfusion injury and the resulting postresuscitation "syndrome" is serious enough to cause recovery complication and death in many instances.

Hence, there exists a need for an improved mechanical CPR device and methods for using the same. It would be desired to develop CPR methods, and particularly CPR methods for use with a mechanical CPR device, that lessen the severity of ischemia/reperfusion injury and that offer an improved level of response and patient treatment. The present invention addresses one or more of these needs.

BRIEF SUMMARY OF THE INVENTION

In one embodiment, and by way of example only, the present invention provides a method for controlling the delivery of cardiopulmonary resuscitation through a mechanical CPR device comprising the steps of: delivering CPR at a first frequency; and subsequently delivering CPR at a second frequency, wherein the second frequency is different from the first frequency. The second frequency may be greater than or less than the first frequency. Additionally, the method may include halting the delivery of CPR for a period of time between the delivery of CPR at a first frequency and the delivery of CPR at a second frequency. Still further, the method may include accelerating (or decelerating) the rate of delivery of CPR from the first frequency to the second frequency.

In a further embodiment, still by way of example, there is provided a method of controlling the administration of CPR to a patient through a mechanical CPR device comprising temporarily alternating between a period of delivery of CPR and a period of non-delivery of CPR. The alternating between a period of delivery of CPR and a period of non-delivery of CPR may begin once mechanical CPR is first delivered to a patient. Additionally, alternating between a period of delivery of CPR and a period of non-delivery of CPR may occur during the first minute after mechanical CPR is first delivered to a patient.

In still a further embodiment, and still by way of example, there is provided a device for the delivery of mechanical CPR that is also configured to regulate the delivery of CPR to a patient comprising: a means for compressing a patient's chest; a means for actively decompressing or permitting passive decompression of a patient's chest; and a controller linked to the means for compressing, and the means for actively decompressing or permitting passive decompression, and wherein the controller is also configured to automatically change over time the delivery of mechanical CPR to a patient. The device may also include a timer linked to the controller, and may also include an input device linked to the controller whereby a user may select a CPR delivery protocol. The controller may be configured to automatically provide mechanical CPR at a first frequency, and subsequently at a second frequency. Additionally, the controller may be configured to temporarily alternate between delivery of mechanical CPR and halting delivery of mechanical CPR. Also additionally, the controller may be configured to accelerate (or decelerate) the frequency of mechanical CPR. Still further the controller may be configured to alter the ratio of compression phase to decompression phase in a CPR cycle. And yet still further the controller may be configured to vary the pressure applied by the means for compressing.

Other independent features, characteristics, and advantages of the mechanical CPR device with a variable resuscitation protocol will become apparent from the following detailed description, taken in conjunction with the accompanying drawings which illustrate, by way of example, the principles of the invention.

DETAILED DESCRIPTION

Figure 1:
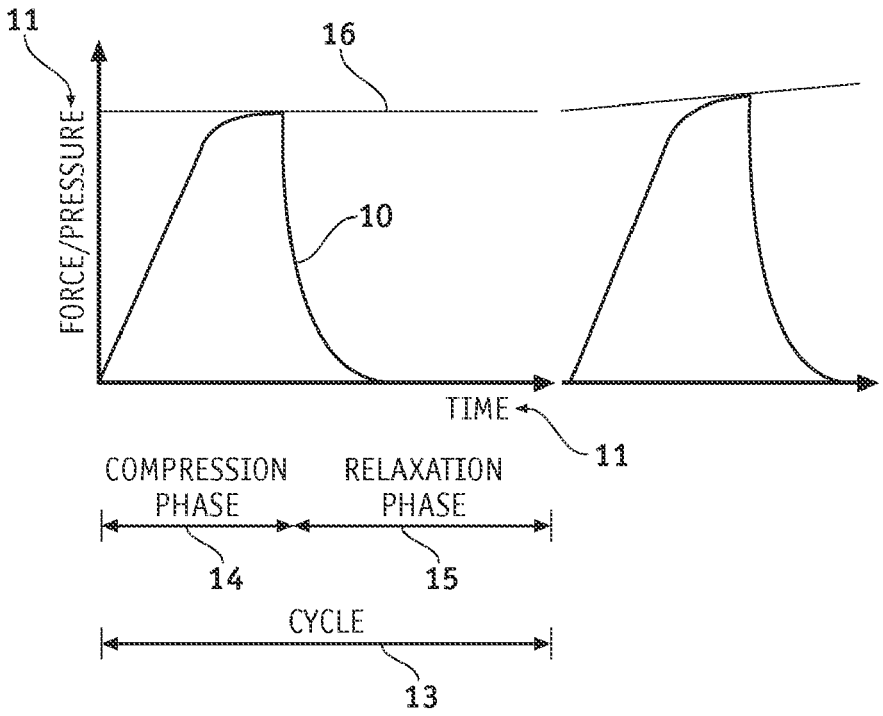
FIG. 1 is a graphical illustration of a typical compression/decompression cycle in a mechanical CPR device.

The following detailed description of the invention is merely exemplary in nature and is not intended to limit the invention or the application and uses of the invention. Furthermore, there is no intention to be bound by any expressed or implied theory presented in the preceding background of the invention or the following detailed description of the invention. Reference will now be made in detail to exemplary embodiments of the invention, examples of which are illustrated in the accompanying drawings. Wherever possible, the same reference numbers will be used throughout the drawings to refer to the same or like parts.

It has now been conceived that the application of CPR, through a mechanical CPR device, can be controlled in a manner so as to lessen the potential for post-treatment ischemia/reperfusion injury. In general, an embodiment of the invention includes accelerating or increasing the delivery rate, or frequency, of CPR when first responding to a patient in a manner that results in blood flow being gradually, rather than suddenly, restored. Another embodiment of the invention includes temporarily alternating on and off the delivery of CPR when first responding to a patient in a manner that similarly results in net blood flow being gradually, rather than suddenly, restored. The gradual or the intermittent restoration of blood flow allows the body's natural metabolism and chemical processing mechanisms to better neutralize the potentially harmful effects of reperfusion and a sudden increase in the supply of oxygen to the body's tissues. The starting point for the gradual or the intermittent restoration of blood flow preferably coincides with the first delivery of CPR to the patient. The method may include control techniques that affect variables in mechanical CPR delivery; these control techniques include, for example, a gradual acceleration (increase) in the CPR delivery rate or also periods of CPR interspersed with periods of non-delivery of CPR. While the CPR control techniques described herein may be performed at any time, they are preferably to be applied to a patient during the first minutes of CPR performance. As is illustrated in FIGS. 1-7 and described below, the disclosed examples of controllably varying the delivery of chest compressions to a patient in a CPR cycle are preset and do not depend on physiological parameters of the patient.

The CPR control methods described herein can be adapted to any mechanical CPR device that provides chest compression. There are various designs of mechanical CPR devices. Many designs rely on a vest, cuirass, strap, or harness that surrounds a patient's chest cavity. The vest/cuirass/harness can be constricted, compressed, inflated, or otherwise manipulated so that the patient's chest cavity is compressed. Other devices may rely on the direct application of force on the patient's chest as through a compressor arm. Regardless of the mechanical means used, the mechanical CPR device effects a compression of the patient's chest cavity. After compression, the mechanical CPR device then experiences a period of decompression. During the period of decompression, the patient's chest cavity is either allowed to decompress passively for a period of time, or is actively decompressed through a direct coupling of the mechanical CPR device to the patient's chest. In a mechanical device decompression may be achieved by relieving pressure and/or force for a period of time. Active decompression in a mechanical device may be achieved by directly coupling the mechanical device to the patient's chest during the decompression phase, for example by use of a suction cup. Other devices may alternate force between a constriction and an expansion of, for example, a belt, harness, or vest.

CPR, including mechanical CPR, is thus a cycle of repeating compressions. Referring now to FIG. 1 there is shown a graphical representation of an exemplary mechanical CPR cycle. The curve 10 represents a plot of varying force or pressure 11 against time 12. The force/pressure is any measure of force or pressure such as pressure applied to a chest cuirass or force applied on the chest. A typical cycle 13 includes a compression phase 14 and a decompression phase 15 in the device. During compression phase 13, force and/or pressure is applied; in the example illustrated force is steadily increased until a plateau pressure 16 is reached. The force is held at the plateau 16. As is known in the art, plateau 16 typically represents a maximum pressure that takes into account considerations of both safety and resuscitation effectiveness. After a desired time, force is released, and this begins the decompression phase 15. A controlled release may occur, providing a gradual decrease in force, or as illustrated, a full uncontrolled (and quicker) release takes place. During the decompression phase 15, pressure decreases. In the example shown, pressure decays until no pressure exists. The decompression phase 15 continues for a desired time, and then a new compression phase 14 begins. The frequency, measured in cycles/unit time, of the compression/decompression cycle is a measure of the rate or speed at which CPR is applied to the patient. Mechanical CPR devices are typically designed with a preset frequency; the present frequency may attempt to mimic the frequency of an ideal human-performed CPR. Thus, a mechanical CPR device may come with a preset cycle frequency of approximately one hundred (100) cycles per minute. Additionally, some mechanical CPR devices are designed to include a regular, periodic pause for ventilation in their protocols. For example, the device may provide for a pause after a set of compressions. Other devices are designed to provide continuous compressions without pause for ventilation. The CPR device with variable resuscitation protocol described herein is equally applicable to either type of mechanical CPR device. Once the device is positioned on a patient and activated, it begins to provide CPR at the preset frequency.

Various mechanical CPR devices are described in U.S. Pat. Nos. 5,743,864; 5,722,613; 5,716,318; 4,570,615; 4,060,079; and U.S. Patent Applications nos. 2003/0135139 A1 and 2003/0135085 A1. These U.S. patents and patent applications are incorporated herein by reference.

Figure 2:
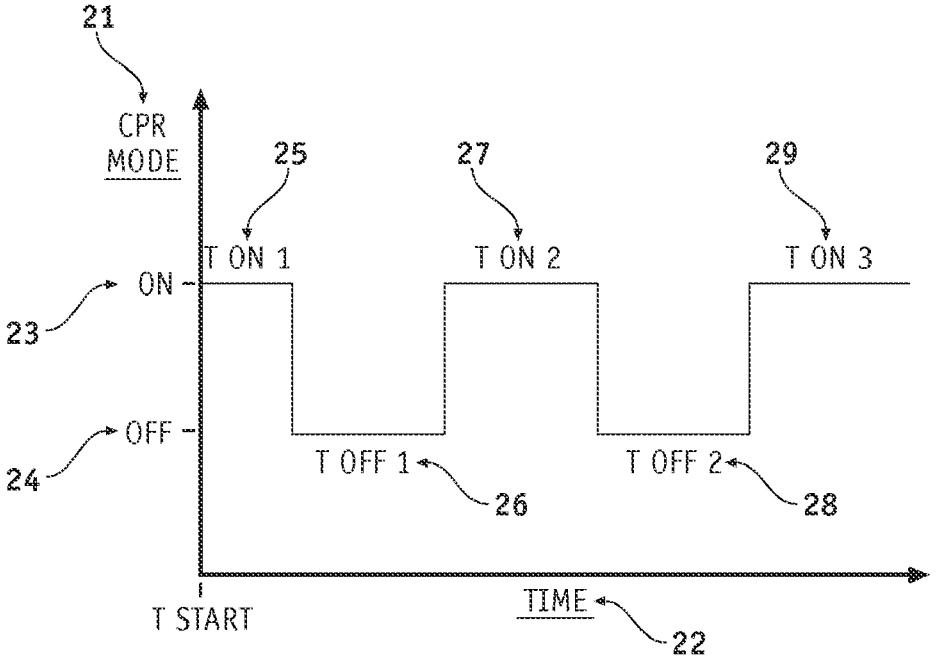
FIG. 2 is a graphical illustration of a form of CPR control according to a first exemplary embodiment in which CPR delivery is alternated between periods of delivery and periods of non-delivery.

Referring now to FIG. 2 there is shown a graphical representation of controlled CPR delivery according to an illustrative embodiment of the invention. The graph is a plot of CPR mode 21 against time 22. In this embodiment, CPR delivery is stuttered between on and off modes 23, 24. The on mode 23 here means a mode in which CPR is being applied to the patient, and off mode 24 means a mode in which there is no application of CPR. Preferably the switching between on and off modes 23, 24 occurs for a period of time after which the device remains permanently in the on mode. Thus, as shown, the protocol begins with CPR being applied for a first interval of time 25, represented as TON1. There follows an interval, TOFF1 26, in which CPR is not applied. Next, CPR is again applied for a period TON2 27. At this point, in some embodiments, the CPR device remains on, without further interruption to the application of CPR. However, in other embodiments, CPR may again switch between an off and on state. Thus, in some embodiments, after TON2 there follows TOFF2 28. Applying CPR again, after TOFF2, there follows TON3 29. This alternating or switching between applying and halting CPR can continue for as many iterations as desired.

It will be appreciated that the lengths of time represented by TON1 25 and TON2 27 may be the same or different. In a preferred embodiment, TON2 is greater than TON1; and if TON3 is present, TON3 is greater than TON2. In this manner, there is a ramp up in CPR delivered to the patient in that each period during which the patient receives CPR is increased in duration.

In similar manner, duration of off periods can be the same or different. Again, in a preferred embodiment, duration of off intervals become successively shorter (i.e., TOFF1>TOFF2). Again, by shortening successive off periods, the patient experiences a gradual ramp up in the active delivery of CPR. The duration of CPR increases. It will also be appreciated that the relative lengths of each TON period and each TOFF period may be the same or different.

In FIG. 2, the graph shows a switching between on and off modes beginning at a start time, Tstart. Tstart may preferably coincide with the first delivery of mechanical CPR to a patient, but that need not be the case. Thus, for example, Tstart, while it indicates a first time with respect to the chart, may also correspond to some time in the patient's treatment history after the first delivery of mechanical CPR. This is also true for the other figures that include a time variable. Thus, the varied or controlled CPR shown in the figures may illustrate CPR control that occurs at any point during mechanical CPR delivery.

The protocol discussed in FIG. 2 deals with a stuttered on/off delivery of CPR. However, CPR delivery may also be varied with respect to other CPR variables, beyond the on/off mode. As discussed, the mechanical delivery of CPR generally comprises cycles of compression and decompression. The rate or frequency of this cycle may be varied. Additionally, the individual components of the cycle, such as force of the compression stroke, may be varied. Finally, the ratio of compression/decompression components (the duty cycle) may also be varied.

Figure 3:
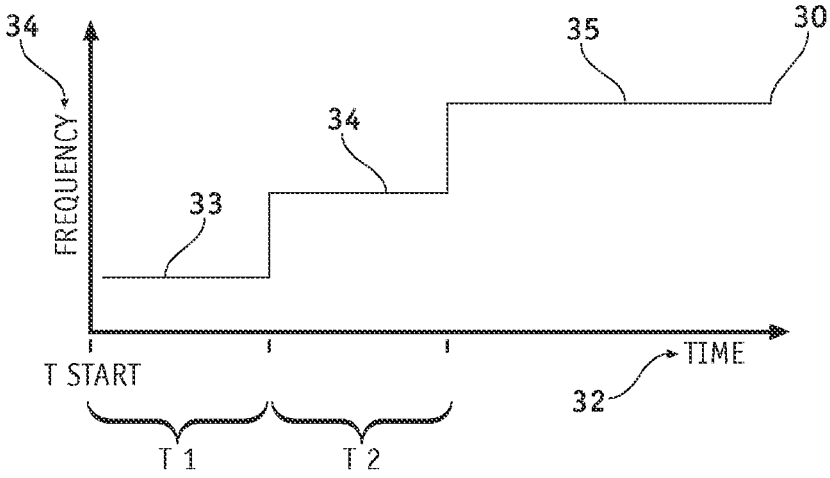
FIG. 3 is a graphical illustration of a form of CPR control according to a second exemplary embodiment in which the frequency of CPR chest compression delivery is changed in step increments.

Referring now to FIG. 3, there is shown a graphical illustration of a varied CPR delivery according to another embodiment of the invention. FIG. 3 represents a plot 30 of the frequency 31 of the CPR cycle (sequence of compression and decompression phases of the device) against time 32. In general terms, FIG. 3 illustrates a step up in the delivery of CPR where the frequency increases from a lower rate to a higher rate. Thus, CPR delivery begins with a frequency 1 33. After a period of time, T1, the CPR frequency is stepped up to frequency 2 34. After a next period of time, T2, the CPR frequency is increased again to frequency 3 35. Jumps, or changes, in frequency can continue for any number that is desired. In a preferred embodiment, a maximum frequency is reached and then held without further higher jumps.

FIG. 3 illustrates an embodiment of a series of step changes in frequency that gradually ramp up until a final frequency is reached. While a positive change in frequency has been illustrated, a step change may also be negative, moving to a lower frequency. In the example illustrated in FIG. 3 time periods for each successive frequency may be of increasing duration, as preferred, where T2>T1. However, the time intervals may be of the same or different durations, including the case in which a successive time period (T2) is shorter than a previous time period where T2<T1.

Figure 4:
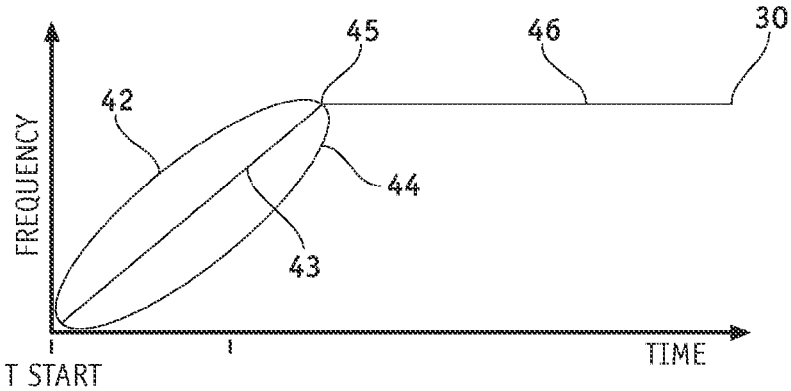
FIG. 4 is a graphical illustration of a form of CPR control according to a third exemplary embodiment in which the frequency of CPR chest compression delivery is accelerated until reaching a desired frequency plateau.

In the embodiment illustrated in FIG. 3, the change in duty cycle frequency is a series of steps; however, in other embodiments, the change in frequency may also follow a more continuous acceleration, without jumps or discontinuities. Referring now to FIG. 4 there is shown a graph that illustrates other embodiments of changes in CPR frequency. As in FIG. 3, the graph in FIG. 4 illustrates CPR that begins at a start time, preferably the time at which mechanical CPR is first applied to a patient. There follows an acceleration period. Three possible acceleration forms are illustrated, a "front loaded" acceleration 42, a linear acceleration, 43, and a "back loaded"

acceleration 44. The term "front loaded" indicates that there is a rapid (non-linear) increase in the cycle, such as exponential growth, followed by a gradual approach to a steady frequency. The term linear indicates that there is a steady rate of increase, as represented by a linear function. And the term "back loaded" indicates that the acceleration occurs later during the time that acceleration occurs, again as represented in example by an exponential or other non-linear function. Each period of acceleration ends at point 45. Following that, there is shown a steady application of CPR at a constant frequency 46. It will be understood, however, that the administration of CPR may continue to be modified and shaped beyond what is illustrated.

Figure 5:
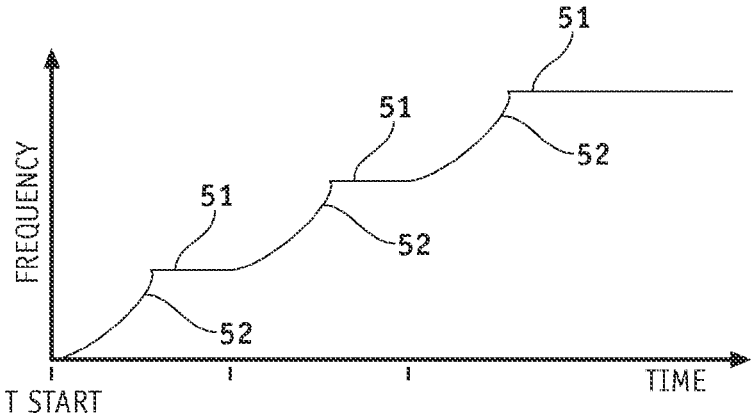
FIG. 5 is a graphical illustration of a form of CPR control according to a fourth exemplary embodiment in which the frequency of CPR chest compression delivery is accelerated to a first plateau frequency, and is then accelerated to a second plateau frequency, and is then accelerated to a third plateau frequency.

A further embodiment, that combines elements of the step increase and continuous increase, is shown in FIG. 5. In this figure, the delivery of CPR is controlled whereby a series of plateaus 51 at successively increasing frequencies are reached. Each successive plateau represents an increase in cycle frequency. However, there is added in FIG. 5 intermittent periods of acceleration 52 between each plateau. The form of intermittent acceleration 52 is shown as nonlinear growth in the figure; however, other forms of frequency acceleration may be applied. The time at each frequency plateau may vary. And, as stated before, changes in frequency need not be exclusively to increase the frequency. Frequency may be decreased, or even halted.

Now it will also be appreciated that on/off mode control may also be combined with any of the forms of control shown in FIGS. 3, 4, and 5. Thus, for example, at any point in the operation illustrated in FIG. 3, 4, or 5, there could be inserted an "off" interval. And after a period of being in off mode, delivery of chest compressions may be commenced again. Further, when stutter control (mixed on/off control) is utilized, along with a control that varies the cycle frequency, the frequency at a second start point need not coincide with the frequency when the "off" mode began. It may be preferred, for example, to begin delivery of chest compressions at a lower cycle frequency than was being done just prior to "off" mode.

While the term "off" or "off mode" or other similar terms, has been used herein, it will be appreciated that this does not necessarily mean that the device powers off or turns off. Rather, it means that delivery of CPR is halted or suspended; CPR delivery is off. Preferably, the CPR device would at all times remain in a powered up, energized condition.

Figure 6:
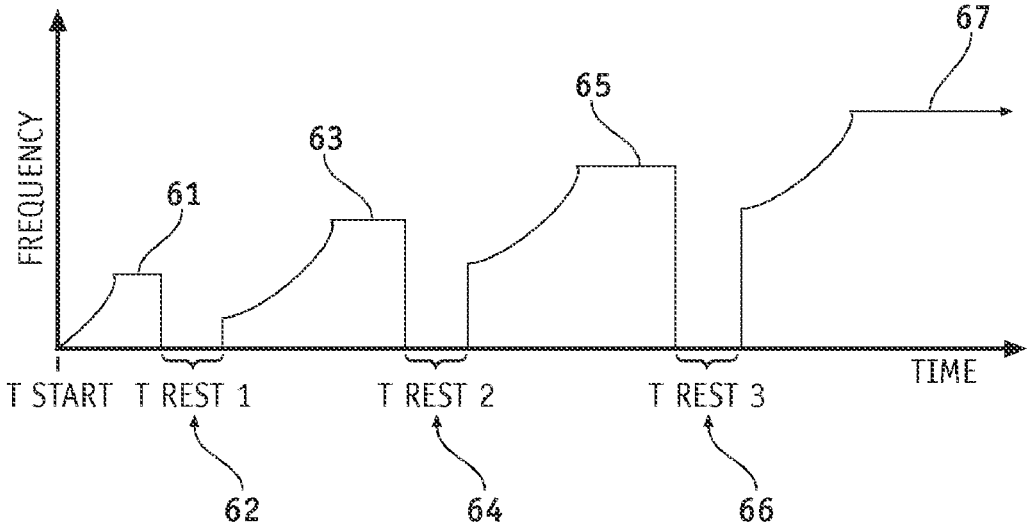
FIG. 6 is a graphical illustration of a form of CPR control according to a fifth exemplary embodiment in which the frequency of CPR chest compression delivery is accelerated to a first plateau frequency, is then halted, is then accelerated to a second plateau frequency, is then halted, and is then accelerated to a third plateau frequency, halted, and finally accelerated to a fourth plateau frequency.

Referring now to FIG. 6, there is shown an embodiment of a more complex control of the CPR frequency that combines accelerations, stepped plateau frequencies, and off periods with no CPR delivery. In this embodiment, CPR is applied at a time Tstart. The frequency of the CPR accelerates to a first frequency plateau 61 at F1 where it is held constant for a desired period of time. CPR is then halted for a period of time, Trest1 62. CPR then begins again. At this point, CPR begins at a frequency F2 that is below F1 61, and the CPR accelerates to a second frequency plateau 63 at frequency level F3. Again, the CPR frequency is held constant for a desired period of time. After that time, CPR again halts for a time. Trest2 64. This pattern is next shown as repeating. After Trest2 64, CPR begins anew, at a frequency lower than second frequency plateau 63, accelerates, plateaus 65, and stops for a Trest3 66. This cycle can then be repeated as many times as desired. Eventually, a maximum frequency FMAX 67 is reached. As shown in FIG. 6, the frequency is held constant at the maximum frequency 67 FMAX, and no further rest periods are taken.

In the embodiment illustrated in FIG. 6, rest periods, Trest1, Trest2, etc., successively grow shorter. Other relationships between rest period durations are possible in other embodiments. And, the time during which CPR is delivered between rest periods, which includes the acceleration phase and plateau phase, grows longer in successive cycles (though other relationships are possible in other embodiments). In this manner, CPR chest compression frequency can be increased over time.

Figure 7:
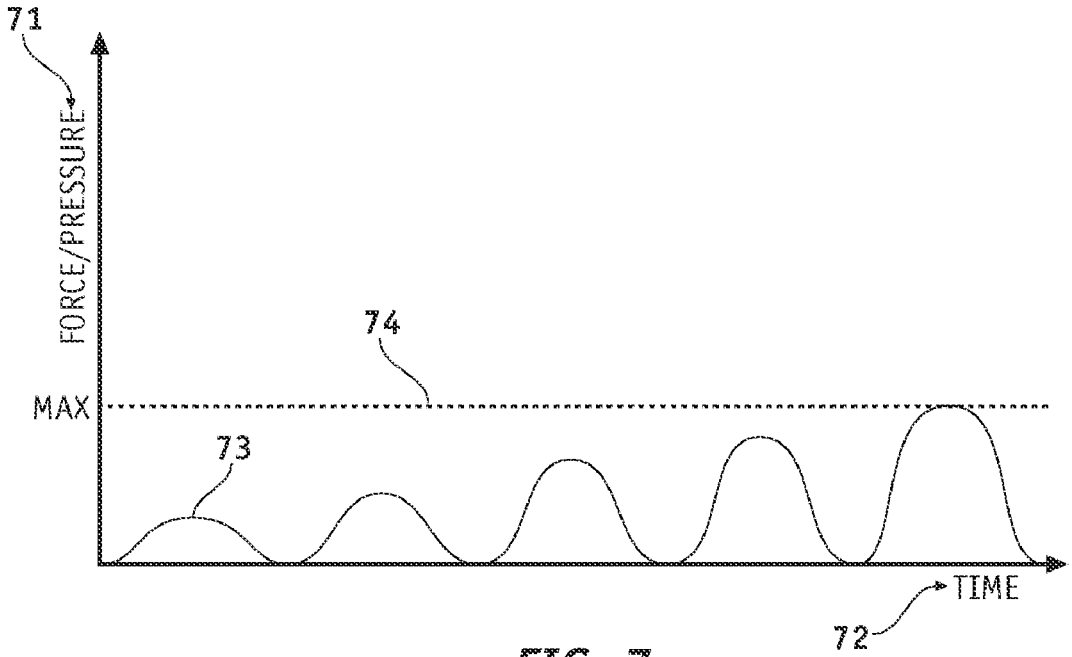
FIG. 7 is a graphical illustration of a form of CPR control according to a sixth exemplary embodiment in which the force in the compression phase of CPR delivery is increasing with time.

As mentioned above, CPR delivery may also be controlled through variation of the compressive force applied to the patient through the CPR device. Referring now to FIG. 7, there is shown a plot of force versus time that illustrates an increase in peak force applied by the mechanical CPR device over time. The curve 73 illustrates a growing magnitude of successive oscillations; this represents that more force/pressure is being applied to successive mechanical CPR cycles. Force/pressure 71 grows until it reaches a desired maximum 74. From that point forward, it would be preferred to maintain the peak force/pressure at the desired maximum.

FIG. 7 represents the magnitude of peak force growing in a relatively linear fashion in successive cycles. However, it will be appreciated that other rates of changes in peak force are possible. For example, peak force may increase or decrease over time in a step wise manner. Likewise force may be increased or decreased non-linearly, such as, for example, by exponential growth or decay.

Also, CPR may be controlled through variations in the compression/decompression cycle. The relative length of the compression phase may change with respect to its corresponding decompression phase. This change in the cycle can also occur so that the overall cycle time remains constant or changes. Thus, in one embodiment, early in mechanical CPR treatment, it may be desired to have a relatively shorter compression phase compared to later compression phases. The relative duration of the compression phase may then gradually be increased (or decreased) from one compression/decompression cycle to the next. As before changes can occur through various functions including step changes, accelerations and decelerations (each of which may be linear or non-linear).

In operation, a mechanical CPR device according to an embodiment of the invention includes a controller. The controller is linked to other device components so as to be able to control compression means and relaxation means that are part of the CPR device. The controller can thus regulate the delivery of CPR including control of parameters such as cycle frequency, on/off delivery of CPR, compression and decompression phase, and compression force. The controller may also be linked to an input device which allows a user to select a form of CPR delivery parameter to be varied and the manner or rate at which it is to be varied.

Figure 8:
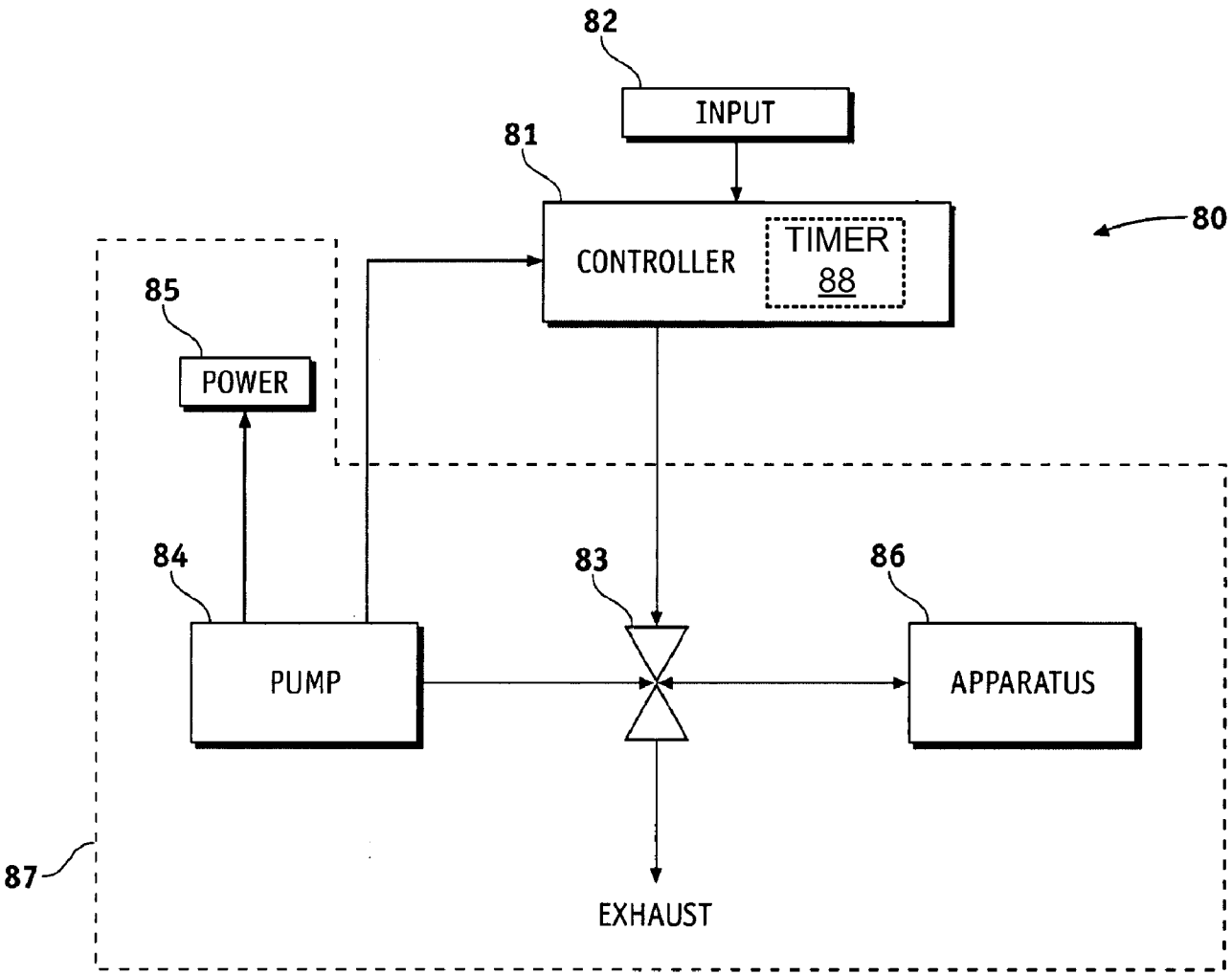
FIG. 8 is a simplified functional block diagram of a mechanical CPR device according to an embodiment of the present invention

Referring now to FIG. 8 there is shown a simplified functional block diagram of a mechanical CPR device according to an embodiment of the present invention. CPR device 80 includes controller 81 with a linked input device 82. Controller 81 is further linked to valve 83 and pump 84. A power supply 85 provides power to pump 84. A compression applying element 86 is also linked to the device 80, as through valve 83. Compression applying element 86 may comprise any of the chest shaping devices mentioned before, such as a vest, cuirass, strap, harness, or compression arm. In operation, pump 84 provides a force, such as pressure, through valve 83 and into compression applying element 86 thereby deforming the compression applying element 86 and compressing the chest. If a device such as a belt is used, it will be understood that force constricts the belt. When desired, valve 83 also releases the pressure thus allowing compression applicator 86 to deflate (relax) and thereby release compressive force on the chest cavity. Additionally, FIG. 8 shows a mechanical CPR means 87. The mechanical CPR means 87 represents the combination of power 85, pump 84, valve 83, and apparatus 86. Mechanical CPR means 87 is also linked to controller 81.

Controller 81 is configured such that CPR delivery follows a desired pattern. A configured pattern may be any of the CPR controls and protocols discussed herein, and variations of the same. In a preferred embodiment, the controller 81 includes software and/or hardware that allows for selection and delivery of a particular CPR delivery protocol. Also, preferably, the controller allows a user to select from more than one CPR delivery forms by an appropriate input 82.

It is also preferred that timer 88 be included in controller 81 or otherwise linked to controller 81. Timer 88 can provide time information needed to follow a desired CPR protocol.

In operation, the preferred delivery of mechanical CPR may be selected depending, for example, on how the patient had been treated prior to the arrival of the CPR device. A patient who had been receiving manual CPR for an extended period of time may be treated differently than a patient who has not received any CPR. In the former case, a quick ramp up time, or even no ramp up time, may be desired; and in the latter case a relatively more gentle, extended ramp up technique may be desired.

In view of the foregoing, it should be appreciated that methods and apparatus are available that allow a mechanical CPR device to follow a variable resuscitation protocol. While a finite number of exemplary embodiments have been presented in the foregoing detailed description of the invention, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing exemplary embodiments of the invention. It should also be understood that various changes may be made in the function and arrangement of elements described in an exemplary embodiment without departing from the scope of the invention as set forth in the appended claims.

What is claimed is:

1. A mechanical CardioPulmonary Resuscitation ("CPR") device for delivering CPR compressions to a patient who has not received such compressions from the device before, the CPR compressions for ultimately forcing the patient's blood to flow, comprising:

a mechanical compression applying element for delivering the CPR compressions to a chest of the patient; and a controller coupled to the compression applying element for regulating a frequency of the first CPR compressions to be delivered to the patient by the mechanical compression applying element, so that the frequency changes automatically in a manner that is preset and does not depend on a physiological parameter of the patient such that at least three successive ones of the CPR compressions are delivered at a frequency that accelerates.

2. The device of claim 1, further comprising:

a timer linked to the controller for providing time information for coordinating the CPR compressions to be according to the frequency.

3. The device of claim 1, in which successive ones of the CPR compressions subsequent to the three are at a frequency that is constant.

4. A controller for a mechanical CardioPulmonary Resuscitation ("CPR") device adapted to deliver first CPR compressions to a patient who has not received such compressions from the device before, the CPR compressions for ultimately forcing the patient's blood to flow, the controller comprising a mechanical compression applying element for delivering the CPR compressions to a chest of the patient, in which the controller is adapted to regulate a frequency of the first CPR compressions for the patient caused by the compression applying element that changes automatically in a manner that is preset and does not depend on a physiological parameter of the patient such that at least three successive ones of the CPR compressions are delivered at a frequency that accelerates.

5. The controller of claim 4, in which a timer is linked to the controller for providing time information for coordinating the CPR compressions to be according to the frequency.

6. The controller of claim 4, in which successive ones of the CPR compressions subsequent to the three are at a frequency that is constant.

7. A mechanical CardioPulmonary Resuscitation ("CPR") device, comprising:

a mechanical compression applying element for delivering first CPR compressions to a patient's chest, the CPR compressions for ultimately forcing the patient's blood to flow; and a controller linked to the mechanical compression applying element for regulating a sequence of the first CPR compressions to be delivered to the patient by the mechanical compression applying element at a frequency that changes automatically in a manner that is preset and does not depend on a physiological parameter of the patient, in which the preset manner is that at least three successive ones of the CPR compressions in the sequence are to be delivered at a frequency that accelerates.

8. The device of claim 7, further comprising:

an input device linked to the controller for a user to select the sequence from a plurality of possible sequences.

9. The device of claim 7, further comprising:

a timer linked to the controller for providing time information for coordinating the CPR compressions to be according to the frequency.

10. A mechanical CardioPulmonary Resuscitation ("CPR") device, comprising:

a mechanical compression applying element for delivering a first set of CPR compressions to a patient's chest, the CPR compressions for ultimately forcing the patient's blood to flow; and a controller linked to the mechanical compression applying element for regulating a timing sequence of the first set of CPR compressions to be delivered to the patient by the mechanical compression applying element, the controller structured to cause the mechanical compression applying element to deliver the first set of CPR compressions at an accelerating frequency, and structured to cause the mechanical compression applying element to deliver the first set of CPR compressions without regard to any sensed physiological parameter of the patient.

11. The device of claim 10 in which:

the first set of CPR compressions comprises three successive compressions, and in which a time period between the second and third of the successive compressions is shorter than a time period between the first and second of the successive compressions.

12. The device of claim 10, further comprising:

a timer linked to the controller for providing time information for coordinating the CPR compressions to be according to the frequency.

13. The device of claim 10, in which successive ones of the CPR compressions subsequent to the first set of compressions are at a frequency that is constant.

* * * * *